United States Patent [19]

Palmaer

[11] 4,123,880

[45] Nov. 7, 1978

[54] ROOF CONSTRUCTION

[76] Inventor: Tore G. Palmaer, Smultronvägen 28, S-331 00 Värnamo, Sweden

[21] Appl. No.: 764,815

[22] Filed: Feb. 2, 1977

Related U.S. Application Data

[63] Continuation-in-part of Ser. No. 580,710, May 27, 1975, abandoned.

[30] Foreign Application Priority Data

May 31, 1974 [SE] Sweden ..... 072240

[51] Int. Cl.[2] ..... E04B 1/34

[52] U.S. Cl. ..... 52/73; 52/90; 52/643

[58] Field of Search ..... 52/90, 91, 92, 93, 639, 52/643, 691, 73

[56] References Cited

U.S. PATENT DOCUMENTS

| | | | |
|---|---|---|---|
| 2,218,926 | 10/1940 | Teichmann | 52/18 X |
| 3,067,544 | 12/1962 | Willatts | 52/643 X |
| 3,423,898 | 1/1969 | Tray et al. | 52/92 X |
| 3,617,691 | 11/1971 | Toyooka | 52/24 X |

FOREIGN PATENT DOCUMENTS

| | | | |
|---|---|---|---|
| 817,035 | 10/1951 | Fed. Rep. of Germany | 639/ |
| 987,706 | 8/1951 | France | 52/90 |

*Primary Examiner*—Price C. Faw, Jr.
*Assistant Examiner*—Carl D. Friedman

[57] ABSTRACT

A roof construction for a single level building having a relatively large central area and peripherally arranged living and storage quarters. The roof construction includes sets of trusses each of which includes at least two generally triangular trusses. The trusses of each such set include a pair of legs angularly inclined relative to each other and a third leg longer than either leg of the pair and connected to the other two legs. The trusses are supported on a pair of vertical supports such that one of the pair of legs rests horizontally upon such vertical supports and the other leg of the pair extends upwardly in cantilevered relation above the central area of the building. The third and longest leg of each truss extends downwardly forming an acute angle with the horizontal and providing a support surface for a roof covering. Corresponding trusses of the respective sets have their inner extremities terminating in close proximity, and a dome-like closure having a transparent area is mounted on the trusses to cover the spaces therebetween and to permit transmission of natural light into the central area of the building.

11 Claims, 12 Drawing Figures

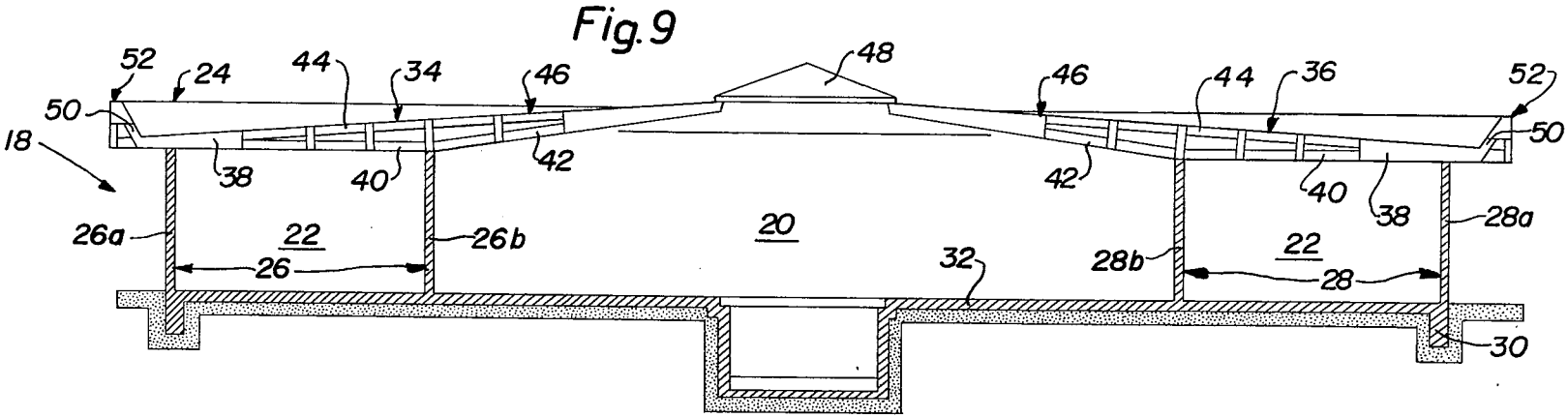
Fig. 9
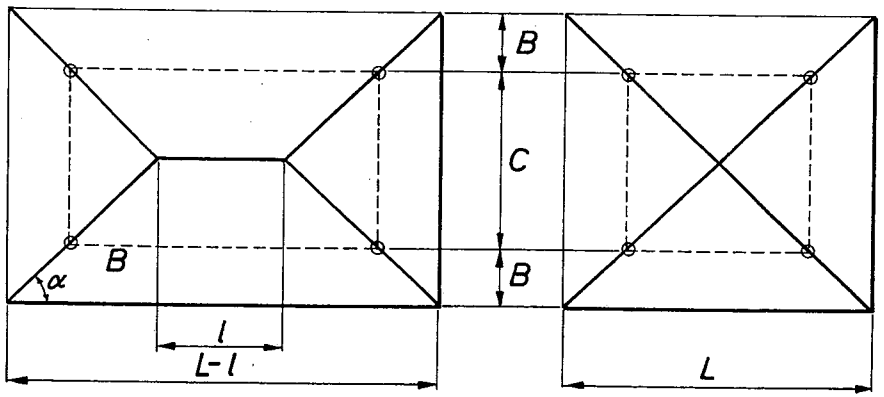
Fig. 10
Fig. 11

ROOF CONSTRUCTION

RELATED APPLICATION

The present application is a continuation-in-part of copending patent application Ser. No. 580,710 filed May 27, 1975 now abandoned. All the subject matter disclosed therein is incorporated rated herein as if more fully set forth.

BACKGROUND OF THE INVENTION

The present invention relates to roof constructions for buildings which are provided with a relatively large central area within which no provision is made for support of the roof. The invention has particular value with buildings which are in the form of a parallelogram in plan and in which at least two pairs of horizontally spaced vertical roof support members extend along sides of the building outwardly of the aforesaid central area.

Heretofore it has been customary to construct residential buildings in rectangular or square configurations in plan view. In order to obtain maximum utilization of land space, and to insure adequate living and storage space within the building, the structures frequently included more than one level. A basement area was often provided; however, due to dampness and limited accessability to natural light the basement area generally was not used for bedroom space or for other living areas deemed essential. The basement frequently was used for storage of the oil burner and tank, clothes washing and drying apparatus, and for a game room area used only occasionally. The result was a multi-storied building in which the normal living space was designed to occupy the above ground level stories. Construction of such multi-storied buildings results in increased labor costs and often in increased material costs.

It has been known heretofore to increase the dimensions of single level buildings so as to provide additional living space at ground level. However, in order to support the simple beams of the roof structure it has been necessary to provide a maze of inner and outer bearing walls. It commercial and industrial construction increased single level building dimensions have been possible by the use of trusses. However, such trusses are generally complex and relatively expensive and sometimes lead to a concentration of forces so as to require vertical supports for the trusses capable of withstanding such concentrated forces and a truss construction also capable of accepting such concentrated forces without danger of structural failure. Further, partially because of the requirements for stronger vertical supports and trusses and for other reasons trusses have not generally been used in the construction of residential buildings.

SUMMARY OF THE INVENTION

In view of the foregoing it is one object of the invention to provide a roof construction for a single level building in which a plurality of trusses are employed in combination with horizontally spaced vertical supports therefor so as to enable an increase in the usable floor space within the building.

It is another object of the invention to provide a roof construction for a single level residential building in which a plurality of trusses are supported on horizontally spaced vertical supports to thereby enable an increase in living space within the building.

It is still another object of the invention to provide a roof construction for a single level building in which a plurality of trusses are supported on horizontally spaced vertical supports to enable an increase in the useful floor area of the building without resorting to a multiplicity of inner vertical supports and/or trusses subjected to load concentrations.

Other objects and advantages of the invention will become readily apparent from the following description of the invention.

In accordance with the invention there is provided a roof construction for a single level building having a relatively large central area over which the roof is unsupported and at least two pairs of horizontally spaced vertical supports for the roof, each of said pairs of horizontally spaced vertical supports being positioned along a different side of the central area, said roof construction comprising at least two sets of trusses each of which includes at least two generally triangular trusses including a pair of legs angularly inclined relative to each other and connected at first ends thereof and a third leg of greater length than either of said pair of legs and connected to the respective other ends thereof; the trusses of a first of the sets of trusses being disposed in parallel spaced relation such that one of said pair of legs of each truss is supported horizontally on the vertical supports of a first of the pair of legs of each truss extending upwardly in cantilevered relation above the central area, and the third leg of each truss extends downwardly forming an acute angle with the one leg thereby providing a support surface for a roof covering; the trusses of a second of the sets of trusses are similarly supported on a second of the pairs of vertical supports and extend over a different portion of the central area; the extremities of corresponding trusses of the first and second sets of trusses terminate in close proximity to each other.

BRIEF DESCRIPTION OF THE DRAWINGS

In order that the invention may be more fully comprehended, it will now be described by way of example with reference to the accompanying drawings in which:

FIG. 9 is an elevational view, partly in cross-section, of a building incorporating a roof construction in accordance with this invention;

FIGS. 10 and 11 are top plan views of typical roof construction embodying the invention.

DETAILED DESCRIPTION OF THE INVENTION

Figure 1:
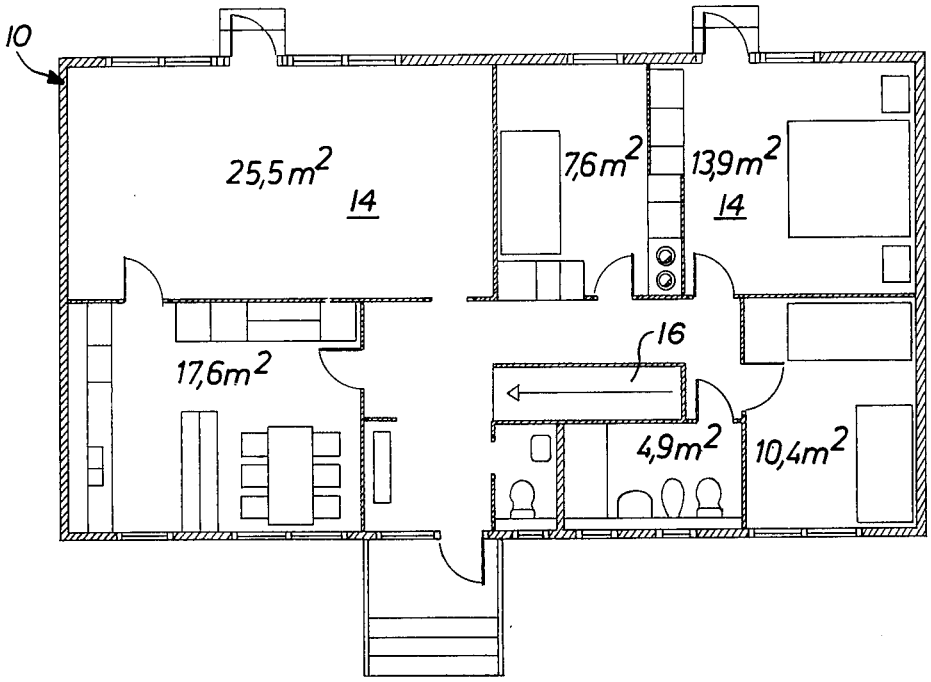
FIG. 1 is a top plan view of the first floor of a conventional two story residential building.
Figure 2:
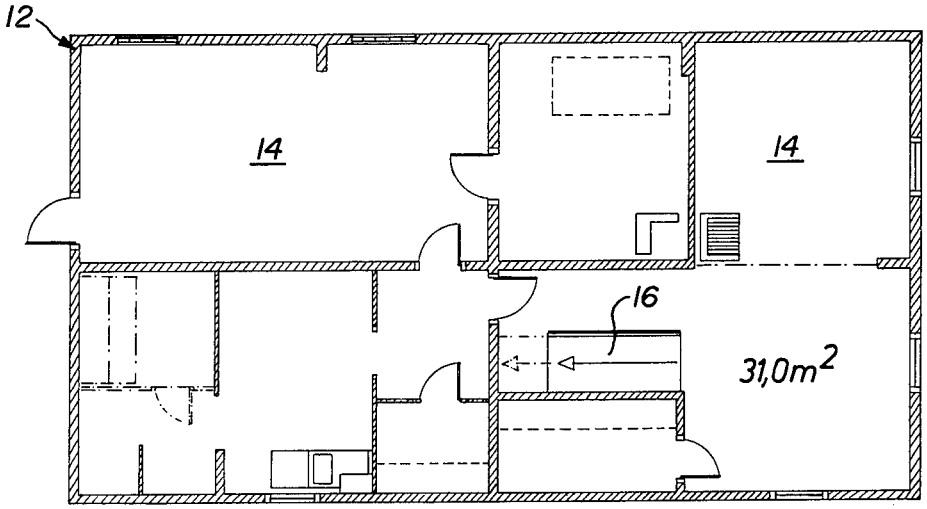
FIG. 2 is a top plan view of the second or upper floor of the building of FIG. 1.
Figure 3:
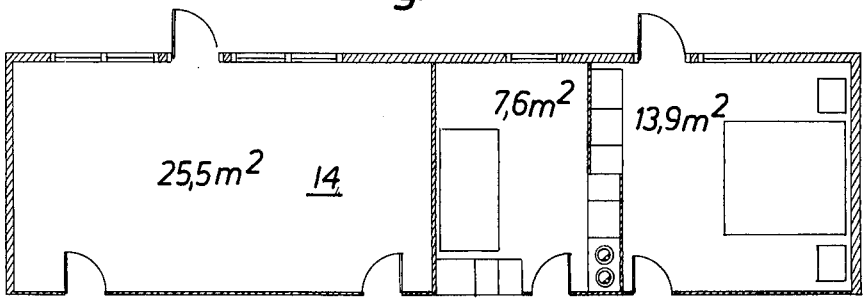
FIGS. 3 and 4 are top plan views of the respective sections of the first floor shown in FIG. 1 on the opposite sides of the longitudinal center line of the building.
Figure 4:
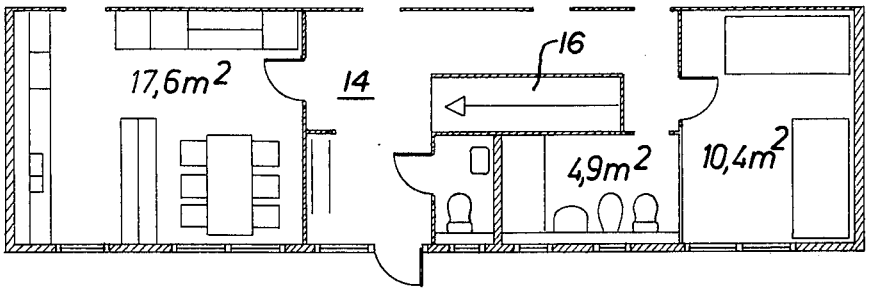
Figure 5:
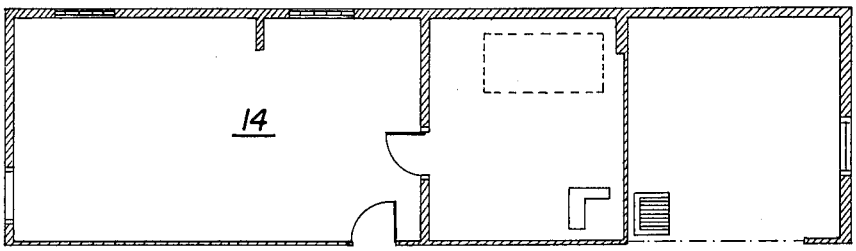
FIGS. 5 and 6 are top plan views similar to those of FIGS. 3 and 4 but of the second floor shown in FIG. 2.
Figure 6:
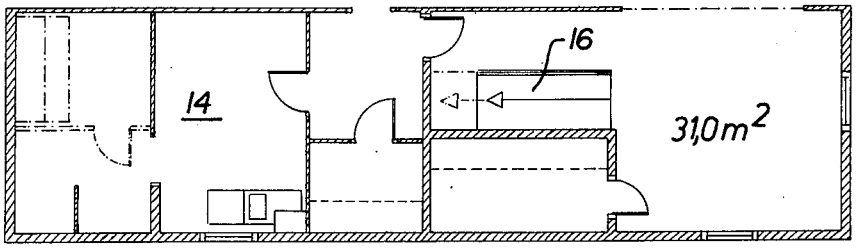

Referring to the drawings, particularly to FIGS. 1 and 2 thereof, there is shown a conventional two story dwelling in which FIG. 1 affords the layout of the ground level 10 and FIG. 2 illustrates the below ground level 12 of the building. It will be observed that each floor level is subdivided into a plurality of living and storage areas 14. The total utilizable area of the building is 103.5 square meters. It can be seen that a portion of each floor must be allocated to provide a stairwell 16 connecting the two levels. Such space is thus not available as living space.

Figure 7:
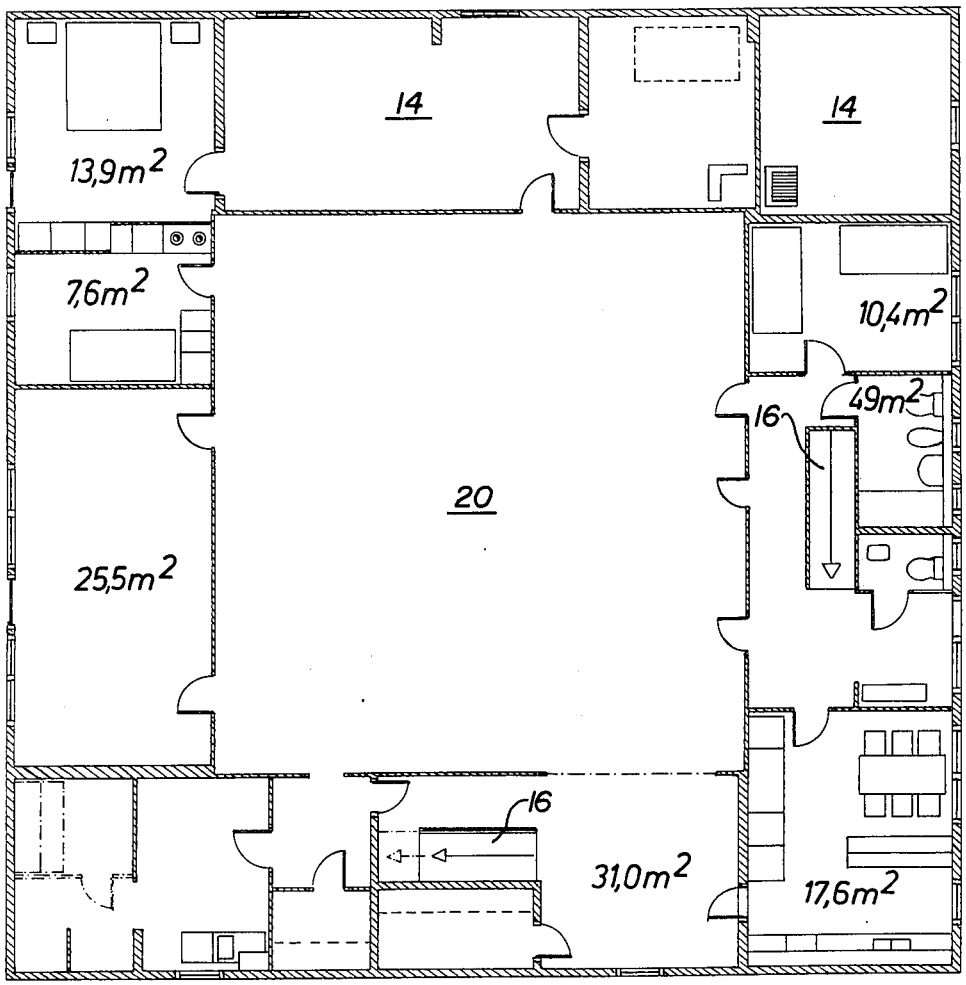
FIG. 7 is a top plan view of the single floor level of a building in which the separate sections of FIGS. 3–6 have been incorporated according to the present invention.
Figure 8:
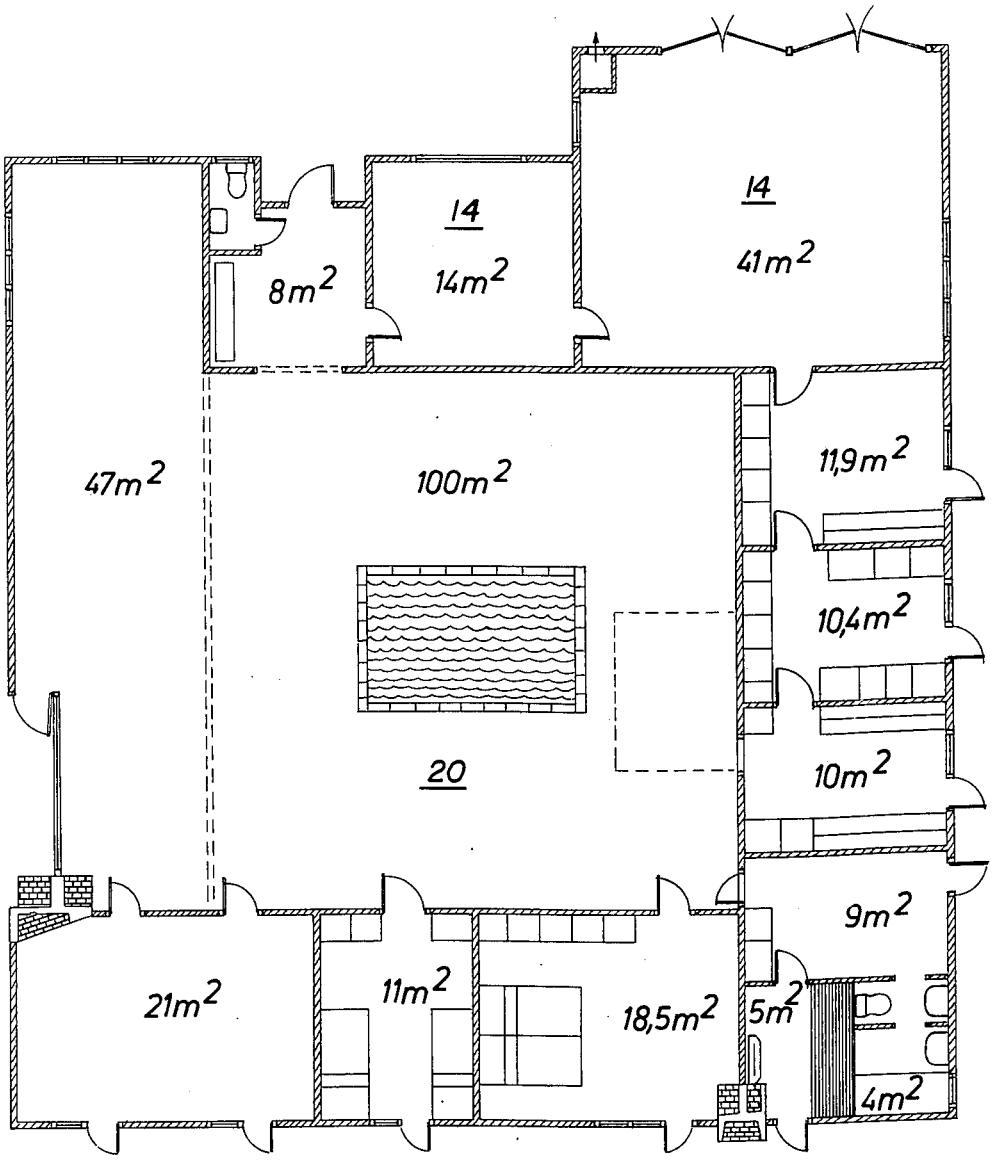
FIG. 8 is a view similar to that of FIG. 7 showing an alternate arrangement of the floor sections of FIGS. 3–6.

By separating the floor sections as depicted in FIGS. 3–6 and rearranging them into a single level building with a layout as shown in FIG. 7, in which the single floor level is at ground level or above, the actual living space area can be increased as may be observed from the following table comparing the areas of a conventional multi-floor dwelling with a single level dwelling.

| Room type purpose | | House type, room area $m^2$ Standard house | | House planned according to Fig. 7 | |
|---|---|---|---|---|---|
| Day rooms: | sitting room | 25.5 | | 47.0 | |
| | all-purpose room | 31.0 | | 100.0 | |
| | dining area | 6.4 | 62.9 | | 147.0 |
| Bedrooms: | 1 | 13.9 | | 17.5 | |
| | 2 | 10.4 | | 11.0 | |
| | 3 | 7.6 | 31.9 | 21.0 | 49.5 |
| Housewife's: | kitchen | 11.4 | | 10.0 | |
| | washing | 8.7 | 20.1 | 10.4 | 20.4 |
| Hygiene: | bath + WC | 7.8 | | 4.0 | |
| | WC | 1.5 | | 1.5 | |
| | sauna (dry heat) | 4.0 | | 5.0 | |
| | changing room | 3.5 | 16.8 | 9.0 | 19.5 |
| Cloak-room: | | 4.0 | 4.0 | 8.0 | 8.0 |
| Garage: | | | | 41.0 | |
| Hobby & store room: | | 23.0 | 23.0 | 11.9 | 52.9 |
| Total useful space: | | | 158.8 | | 298.3 |
| Passages, stairs, walls: | | 48.2 | 48.2 | 10.5 | 10.5 |
| Total living area (excl. outer walls) | | | 207.0 | | 308.8 |

It will be seen from the foregoing table that by rearranging the floor space the total useful space is approximately doubled whereas the non-livable area is decreased by approximately 75%. The floor and roof area has been increased by approximately 100 square meters. Of at least equal importance, however, is the location of all the living space at or above ground level on a single floor facilitating communication between the various areas of the building as well as between any area of the building and the area surrounding the building. The latter feature is of particular value to physically handicapped persons.

In order to achieve the design of the living space for a building was shown in FIG. 7, in which the various living and storage quarters are arranged peripherally about a central area within the exterior walls of the building, it would be anticipated that the roof construction for such a building would constitute a significant problem. Indeed with conventional roof constructions heavy beam work or trusses would be necessary, thereby substantially increasing the cost of constructin and rendering it difficult to provide access to natural sunlight.

Referring to FIG. 9 it will be seen that the building 18 includes a relatively large central area 20 and a peripherally extending area 22 within which there are located the various designed living and storage quarters. A roof 24 covers the building and is supported upon pairs 26, 28 of vertical support members which extend peripherally around the building. The outermost of such members *26a*, *28a* preferably constituting exterior wall members and the inner members *26b*, *28b* constituting inner wall members of the building. It will be understood, of course, that beam and post construction may be employed if desired with non-bearing partitions extending between the posts instead of utilizing continuous bearing walls throughout the periphery of the building. As shown in FIG. 9 a footing 30 may be provided for the exterior wall member whereas the inner vertical support member may rest upon a floor slab 32. However, the particular foundation for support of vertical support members 26, 28 may be selected to best accomodate the remainder of the building design. In all instances it will be observed that the roof is unsupported and extends cantilever-fashion over the central area 20 of the building.

The roof construction comprises at least two sets 34, 36 of trusses each of which sets includes at least two generally triangular trusses 38 having a pair of legs 40, 42 angularly inclined relative to each other and connected at adjacent ends. Each truss includes a third leg 44 of greater length than either of the other legs and connected therebetween. The trusses employed in the invention are relatively short in comparison to conventional trusses which would normally be employed to extend across equivalent internal building spaces.

Figure 12:
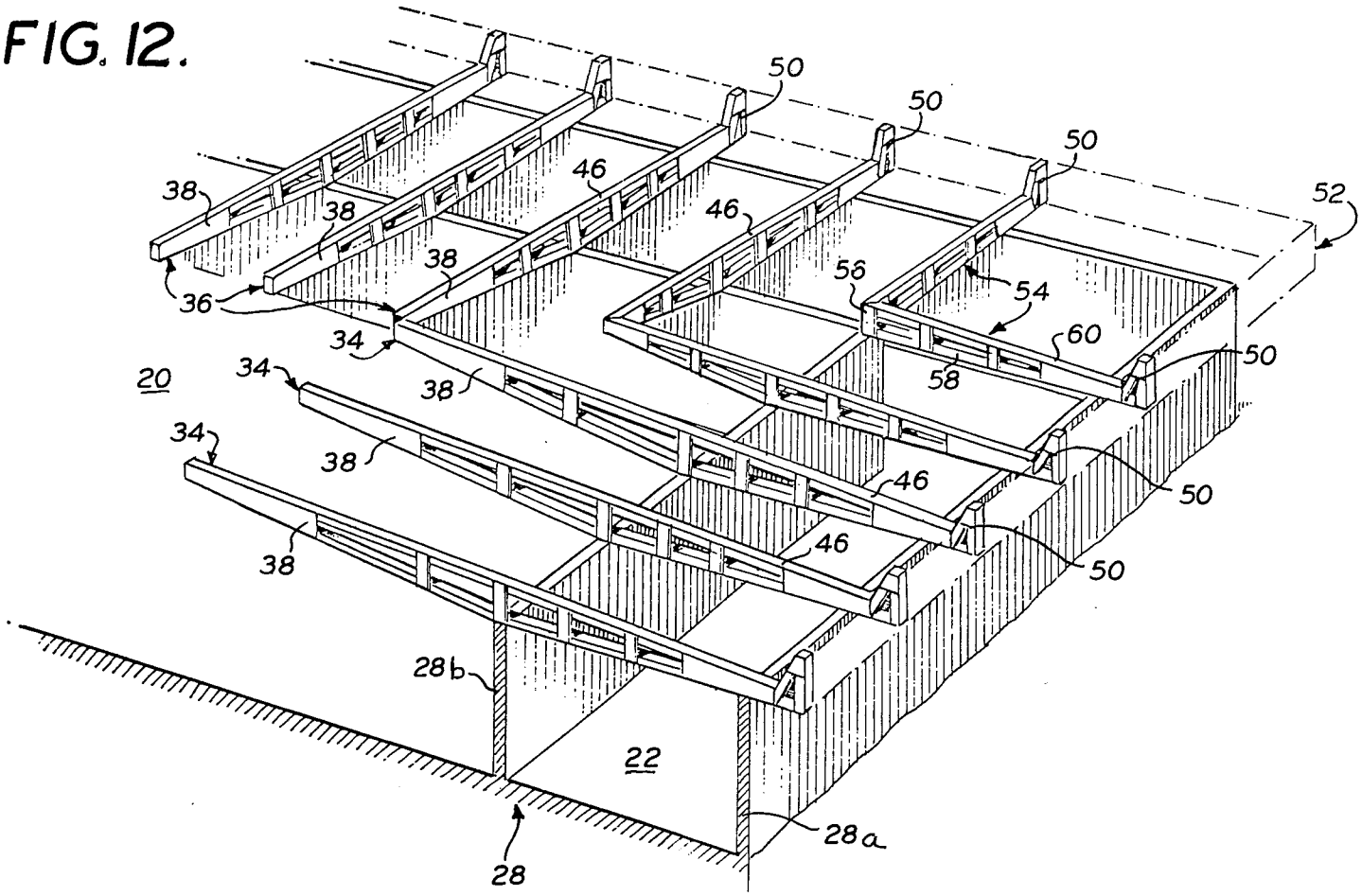
FIG. 12 is a fragmentary perspective view of another embodiment of a roof construction embodying the invention.

As can be seen clearly in FIGS. 9 and 12 one of legs 40, 42 of each truss of the respective sets of trusses is supported in horizontal disposition on vertical support members *26a* and *26b* or *28a* and *28b*, the other leg of the pair extending upwardly in cantilevered relation above central area 20 of the building. The leg 44 thus extends downwardly and forms an acute angle with the leg supported on the vertical support members and provides an upper support surface 46 for a conventional roof covering such as slate, asphalt shingle or the like. It will be noted that the inner extremities of the corresponding trusses in the sets of trusses 34, 36 terminate adjacent each other in close proximity. A dome-like closure member 48 is supported on the respective trusses to cover the spaces therebetween. The dome may be fabricated of transparent material so as to provide the introduction of natural light to central area 20 of the building. However, where desired the dome may be formed with an opaque roof and vertical windows.

Preferably the legs 40, 42 of each truss 38 are of equal length and form, in conjunction with leg 44, an isoceles triangle. However, it is within the ambit of the invention to form the truss with legs 40, 42 of different lengths. Both of such legs, however, are shorter than leg 44 which is disposed in overlying relation to legs 40, 42 when the truss is incorporated in the roof construction.

The horizontally disposed leg of the truss, as stated above, rests upon both of the vertical supports such that substantially half of the total roof load carried by the truss is transmitted to such leg and thence to its vertical supports.

An upwardly extending snow stop 50 is desirably formed integrally with each truss so as to form a peripherally extending snow barrier 52 when all of the trusses are in position. The provision of such a snow barrier will serve to retain an accumulated blanket of snow on the roof during the winter months as an insulating layer.

The dome 48 may be configured so as to insure gravitation of the snow against the snow barrier to maintain entry of natural light and sunlight into central area 20 even during the winter months. Further, with the roof construction of the invention the snow load will tend to concentrate upon the section of the roof overlying the pairs of vertical supports 26, 28 thereby avoiding the development of excessive loads upon the cantilevered section.

The buildings constructed in accordance with the invention are in the form of a parallelogram in plan view such as rectangular or square. It will be understood, however, that such buildings may include one or more wings of similar configuration such that an overall irregularly shaped building results.

As can be seen in FIG. 12 the pairs of vertical supports which support the respective sets 34, 36 of trusses 38 may be located along adjacent and perpendicularly oriented sides of the building. One or more of the corners of such a building may include a pair of right angle trusses 54 including a pair of legs 56, 58 which are connected to form a right angle therebetween and a third leg 60 which is the longest leg of the three and serves to support the roof covering. As can be further seen from FIG. 12, the inner extremities of the corresponding trusses may be complementarily mitered to achieve close abutment and enhanced roof rigidity.

FIGS. 10 and 11 show typical roof shapes which can be formed with the roof construction of the invention. As shown, the relationship between the components of each such roof is as follows, and in order to insure stability of the roof the generally formula set forth below should be employed in establishing the stated relationships:

$$C^3 + 3\,C^2L\,(tg\alpha) = 16B^3 + 12B^2C + 12B^2ltg\alpha$$

in which:

C is the width of the inner cantilever roof of the house $tg\alpha$ is the angle of the roof diagonales with respect to the longitudinal wall of the house B is the width of the outer roof section in the longitudinal direction of the house L is the length of the roof and $l$ is the projected length of the ridge (i.e. without the roof window)

What is claimed:

1. A roof construction and roof support system for a single level building having a relatively large central area over which the roof is unsupported and at least four pairs of horizontally spaced peripherally extending vertical supports for the roof, each of said pairs of horizontally spaced vertical supports extending along a different side of the central area, said pairs of vertical supports extending substantially completely around and defining therewithin said central area, said roof construction comprising:

at least four sets of trusses each of which sets includes at least two generally triangular trusses each including a pair of legs angularly inclined relative to each other and connected at first ends thereof and a third leg of greater length than either of said pair of legs and connected to the respective other ends thereof;

the trusses of two of said sets of trusses being disposed in opposite substantially colinear relation, the trusses of the respective ones of said two sets of trusses being spaced and parallel to each other and arranged such that one of said pair of legs of each truss is supported horizontally on the vertical supports of one of said pairs of supports, the other of said pair of legs of each truss extending upwardly in cantilevered relation above the central area of the building, and the third leg of each truss extending downwardly forming an acute angle with said one leg thereby providing a support surface for a roof covering;

the trusses of two other of said sets of trusses being disposed substantially perpendicularly to said first mentioned two sets of trusses and in opposite substantially colinear relation to each other, said two other sets of trusses being similarly supported respectively on two other of said pairs of vertical supports which extend substantially perpendicularly to the pairs of vertical supports supporting said first mentioned two sets of trusses, the trusses of said two other sets of trusses thus extending over different portions of the central area, the extremities of corresponding trusses of each of said first mentioned two sets of trusses and of said two other sets of trusses terminating in close proximity to each other.

2. A roof construction according to claim 1, wherein a dome-like roof closure having transparent sections is supported upon the said extremities of said corresponding trusses so as to cover the spacing therebetween and permit the introduction of natural light to the central area of the building.

3. A roof construction according to claim 1, wherein said pairs of vertical supports are positioned to extend along the sides of the building.

4. A roof construction according to claim 3, wherein the vertical supports of said pairs of supports comprise wall members of the building.

5. A roof construction according to claim 4, wherein a footing is provided for the outermost of said wall members.

6. A roof construction according to claim 1, wherein the vertical supports of each said pair of supports are spaced from each other a distance such that half the roof load for the section of the roof supported thereon is carried thereby.

7. A roof construction according to claim 1, wherein an upwardly extending snow barrier is provided on said trusses adjacent the lowermost extremities thereof, said snow barrier extending peripherally around the roof.

8. A roof construction according to claim 1, wherein each said pair of vertical supports support the trusses thereon at the apices of said pair of legs for each truss and at a location spaced inwardly from the juncture of said first and third legs of the trusses.

9. A roof construction according to claim 1, wherein said sets of said trusses are supported respectively on corresponding pairs of said vertical supports, the building being in the form of a parallelogram in plan with said the pairs of vertical supports being located along the sides of the building.

10. A roof construction according to claim 1 for a building which has the form of a parallelogram in plan, wherein the vertical supports of each said pair of supports are spaced apart by a distance B, the distance between opposed pairs of said supports is C, the building has a length L and the relationship between B, C and L is governed by the following general formula:

$$C^3 + 3\,C^2L\,(ta\alpha) = 16B^3 + 12B^2C + 12B^2\,(ltg\alpha)$$

and in which $l$ is the projected length of the ridge and $tg\alpha$ is the angle of the roof diagonals with respect to the longitudinal wall of the building.

11. A roof construction and roof support system for a single level building having a relatively large central area over which the roof is unsupported and two pairs of horizontally spaced vertical supports for the roof, each of said pairs of horizontally spaced vertical roof supports extending along a different and adjacent side of the central area, said respective pairs of vertical roof supports being disposed perpendicularly to each other, said roof construction comprising:

two sets of trusses each of which sets includes a plurality of spaced, parallel and generally triangular trusses each including a pair of legs angularly inclined relative to each other and connected at first ends thereof and a third leg of greater length than either of said pair of legs and connected to the respective other ends thereof;

the trusses of a first of said sets of trusses being arranged on said vertical supports such that one of said pair of legs of each truss is supported horizontally on the supports of one of a first of said two pairs of vertical supports, the other of said pairs of legs of substantially every truss extending upwardly in cantilevered relation above the central area of the building, and the third leg of each said truss extending downwardly forming an acute angle with said one leg thereby providing a support surface for a roof covering, the lengths of adjacent trusses of said first set of trusses progressively increasing from the first to the last in line;

the trusses of the second of said sets of trusses being arranged on the second of said two pairs of vertical supports in similar manner to the trusses of said first set and extending substantially perpendicular to the trusses of said first set, the unsupported ends of corresponding ones of the trusses in said first and second sets thereof terminating in close proximity to each other.

* * * * *